United States Patent [19]

Guidry

[11] 4,279,096

[45] Jul. 21, 1981

[54] PULL TOY

[76] Inventor: Debra K. Guidry, P.O. Box 1152, 115 St. Peters Ct., Donaldsonville, La. 70346

[21] Appl. No.: 128,096

[22] Filed: Mar. 7, 1980

[51] Int. Cl.[3] ..... A63H 33/00; A63H 33/06

[52] U.S. Cl. ..... 46/11; 46/17; 46/152; 46/103

[58] Field of Search ..... 46/11, 201, 103, 111, 46/112, 152, 123, 124, 97, 16, 17, 202; 220/8, 23.86

[56] References Cited

U.S. PATENT DOCUMENTS

| | | | |
|---|---|---|---|
| 1,521,573 | 12/1924 | Myers | 46/103 |
| 2,511,154 | 6/1950 | Garland | 46/152 X |
| 2,770,915 | 11/1956 | Hicks | 46/201 X |
| 2,799,969 | 7/1957 | Henrickson | 46/201 X |
| 2,815,605 | 12/1957 | Connell | 46/152 X |
| 3,018,583 | 1/1962 | Novotney | 46/11 |
| 3,195,265 | 7/1965 | Marquez et al. | 46/11 |
| 3,235,263 | 2/1966 | Smith | 46/17 X |
| 3,660,926 | 5/1972 | Lerner et al. | 46/11 X |
| 3,883,983 | 5/1975 | Coster | 46/17 |

FOREIGN PATENT DOCUMENTS

| | | | |
|---|---|---|---|
| 2532841 | 3/1977 | Fed. Rep. of Germany | 46/16 |
| 899990 | 6/1962 | United Kingdom | 46/17 |

*Primary Examiner*—Gene Mancene
*Assistant Examiner*—Mickey Yu
*Attorney, Agent, or Firm*—Harvey B. Jacobson

[57] ABSTRACT

A pull toy comprising a plurality of cans or cylinders of decreasing length and diameter nested linearly inside one another, said cans being fastened to successive can components by an elastic band connector. The largest of the plurality of cans is equipped with supporting wheels or rollers and a removable lid, said largest can serving not only as the first element in the completed toy when in extended form but also as a protective case for the other can components, said can components fall from the largest can when the lid is removed and the toy is pulled. The elastic band connectors can be disassembled enabling a young child to play with the separate can components.

8 Claims, 5 Drawing Figures

PULL TOY

BACKGROUND OF THE INVENTION

1. Field of the Invention

The present invention is directed to a pull toy having a plurality of components nestable one within another in linear-like fashion, the toy to be used primarily by preschool children. There are a great number of toys for babies and young children. Such toys should bring enjoyment to the child and also expose the child to some of nature's wonders, stimulating the child's imagination and curiosity. Pull toys because of their movement have long been a favorite of children everywhere. The present invention provides for a pull toy of nestable components flexibly interconnected which also exposes a young child to nature's elements of size and space, color, movement, sound, self-image and even has the element of surprise.

2. Disclosure Statement

Wheeled pull toys converted from discarded tin cans or containers are shown in U.S. Pat. No. 2,770,915, issued Nov. 20, 1956 to Hicks, and U.S. Pat. No. 3,883,983, issued May 20, 1975 to Coster. Gausewitz in U.S. Pat. No. 3,138,895, issued June 30, 1964, discloses a plurality of containers stored and received in a larger container, while Zalkind in U.S. Pat. No. 2,747,324, issued May 26, 1956, discloses a plurality of interconnected pull toys. Henrickson in U.S. Pat. No. 2,799,969, issued July 23, 1957, discloses the concept of a plurality of wheeled box-like toys orientated in nested relationship in which adjacent segments of the toy are pivotably connected to each other for movement between their nestable position and their extended position. None of the above patents discloses a plurality of flexibly interconnected cans or cylinders nested linearly in one another as the pull toy of the present invention.

SUMMARY OF THE INVENTION

The present invention is directed to a pull toy made up of a number of substantially rigid components nestable one within another and flexibly interconnected so that the components may be disposed in tandem and thus pulled by a young child through a towing string attached to the front end. The exterior surface of the pull toy may be decorated and formed so as to simulate an elongated animal such as a worm, snake or alligator, or the like, and even to simulate a long bodied vehicle such as a locomotive. Briefly, the invention includes a plurality of open-ended cylindrical shaped components (cans) of progressively decreasing size nested linearly one within another, connected by an elastic connecting means, the largest can serving not only as an end of the toy in extended form but also includes a lid and can be used as a protective case for the other cylindrical components. The largest can may include wheels and be decorated as a complete toy. The invention is such that all of the can components can be nested in the largest can and released therefrom in a linear-like fashion when the lid on the largest can is removed and the toy pulled, thus extending the toy to a length several times greater than its width. The elastic connectors for the individual cans can be disassembled and thus the separate components may serve as playthings for a young child.

Accordingly, an object of the invention is to provide a pull toy composed of a plurality of flexibly connected nestable components.

Another object of the invention is to provide a pull toy adapted to be several times longer than its width when extended and capable of being assembled in compact form for storage.

A further object of the invention is to provide a toy composed of a plurality of connected components that can be disassembled to provide a plurality of individual component members.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
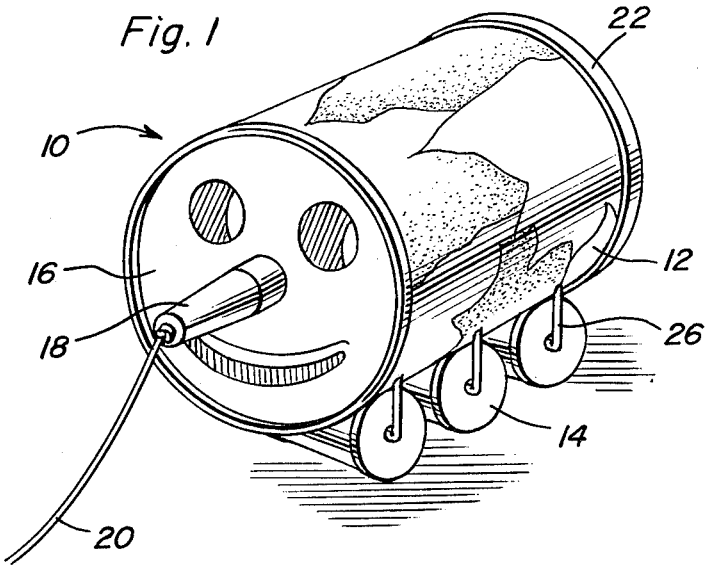
FIG. 1 is a perspective view of the pull toy illustrating the largest body can which holds the other can components.
Figure 2:
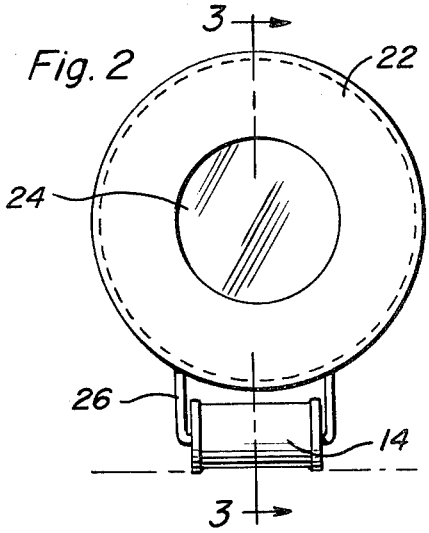
FIG. 2 is a rear elevational view of the pull toy.

As shown in the perspective view of FIG. 1, pull toy 10 may be in the shape of a tin can. The toy is made up of a body can 12 which is the largest can component and serves as a storage container for all the other components. Body can 12 includes rollers or wheels 14, three of which are shown though any number of wheels which will provide easy movement is appropriate, attached to can body 12 by wheel supports 26. As shown in FIG. 1, body can 12 can be decorated in any fashion though a decorated exterior to simulate a long-bodied animal such as a snake, worm or alligator or even a long-bodied vehicle such as a train are preferred decorations. Body can 12 can also include a face 16 painted or otherwise formed on the closed end thereof. A pull string 20 is attached to the closed end of body can 12, such as to extended nose 18 of face 16. The end of body can 12 opposite face 16, is an open end which is covered by lid 22 to hold the other components. Lid 22 can include an unbreakable circular mirror 24 made of polished stainless steel or the like, placed in the center thereof.

Figure 3:
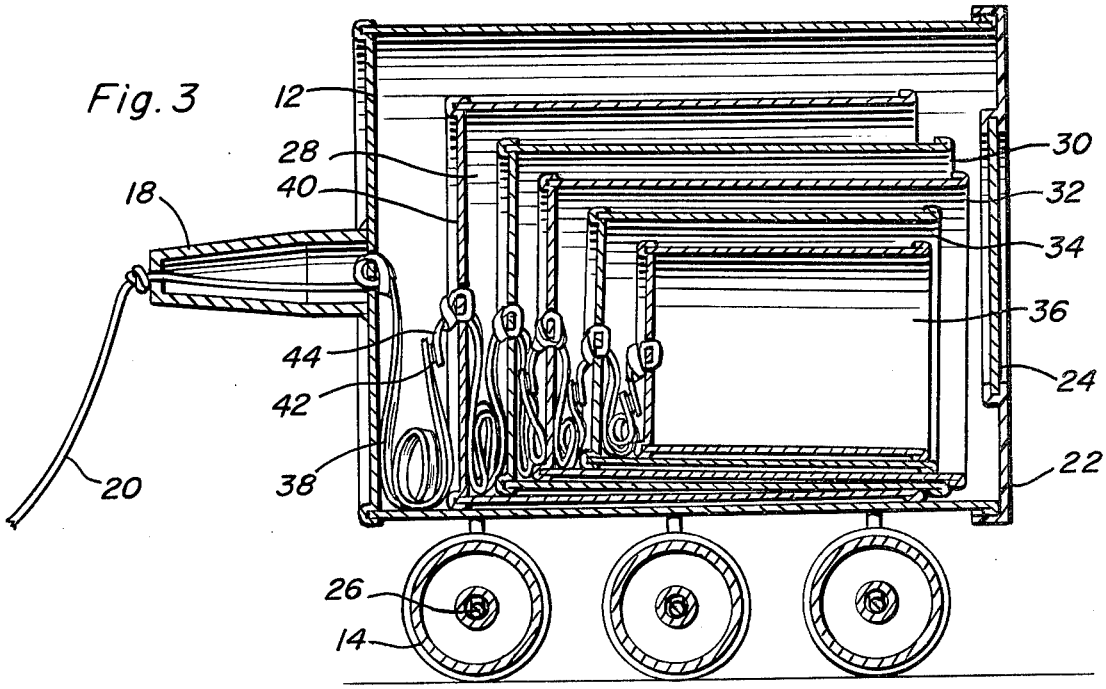
FIG. 3 is a longitudinal sectional view of the pull toy taken generally along line 3—3 of FIG. 2.
Figure 4:
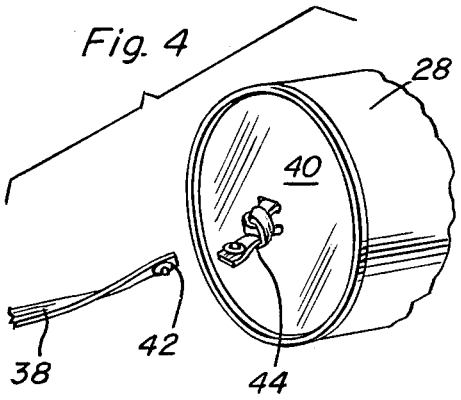
FIG. 4 is a perspective view of a can component and the elastic connecting means of the invention.

FIG. 3 shows all of the other can components 28, 30, 32, 34 and 36 nested in body can 12 and within one another confined in body can 12 by lid 22. As can be seen in FIG. 3, the other can components are each open ended and are of decreasing length and diameter so that they can be nested in a linear manner. All of the can components are interconnected in sequence by elastic band connectors 38, tied or otherwise attached to the closed end of each can such as end 40 of can 28. Elastic band connectors 38 can be made of any known elastic material. Elastic band connectors 38 are provided with snap fasteners 42 as shown in FIG. 4 at each end of connector 38 though other conventional fastening means such as "Velcro" fasteners are acceptable to interconnect the individual can components in sequence. The elastic band connectors 38 are tied through slits 44 placed in the closed end of each can such as closed end 40 of can 28 and are positioned so that one end of connector 38 containing fastener 42 is positioned outside and adjacent the closed end of each can and the other end of elastic band connector 38 extends into the can interior and to about the closed end of the next can in sequence. For example, elastic band connector 38 tied to can 28 extends into the interior of can 28 and is fastened to fastener 42 of elastic band connector 38 tied to can 30. The length of the elastic band connectors 38 between each can enables each can to be almost completely removed from the preceding larger can into which it is nested when the toy 10 is in extended position. An advantageous feature of the present invention is that elastic band connectors 38 for each can may be unfastened enabling a young child to experiment or play with a plurality of individual can components.

Figure 5:
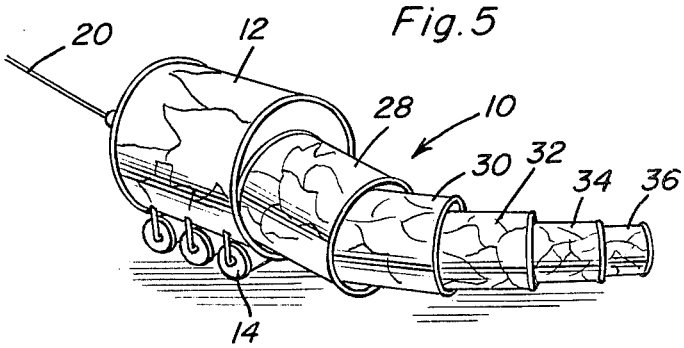
FIG. 5 is a perspective view of the pull toy in fully extended form.

In the operation of pull toy 10, lid 22, which is preferably of plastic material and frictionally held on the can 12, is removed from body can 12 and the toy pulled by a child through pull string 20 enabling can body 12 to move or roll due to wheels 14 held to body can 12 by supports 26 causing can components 28, 30, 32, 34 and 36 nested in linear fashion in can body 12 to be released and fall to the floor. The fully extended pull toy 10 is shown in FIG. 5. The exterior of can components 28, 30, 32, 34 and 36 can be decorated in any fashion but preferably in a design consistent with can body 12. As stated beforehand, the exterior decoration can be such as to simulate a long bodied animal or long bodied vehicle. The pull string 20 may even be attached to the smallest can if adapted to include two closed ends whereby in this instance the can components are pulled from can body 12.

The pull toy of the present invention enables a young child to experiment or play with the toy in a variety of ways. When elastic band connectors 38 are disassembled or unfastened and the cans are separated into individual components, a child may experiment with the individual components in many different ways such as fitting the cans in one another, lining the cans up side by side and even use the separate can components as building blocks, exposing the young child to size and space relationships. The pull toy 10 can be pulled in fully extended form as shown in FIG. 5 or in the form of body can 12 only, with lid 22 covering the open end, as shown in FIGS. 1 and 3. A young child is exposed to the concept of movement on wheels, inertia forces causing the smaller cans to "spill" out the rear of the can 12 and even to the sense of sound as the individual can components hit the floor and each other during movement. While toy 10 can be decorated in various colors that are pleasing to a child, a simulated animal or vehicle decoration exposes the child to various animals or objects that are present in the surrounding environment. The mirror can also function to promote the self-image of a child. The sudden release of can components 28, 30, 32, 34, and 36 from can body 12 also familiarizes the child with the all too present element of surprise.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pull toy comprising a plurality of cylindrical shaped components of different diameters, said components arranged in a linear fashion and being progressively smaller in diameter from the largest to the smallest, whereby a portion of each component except the largest is nested in the next larger cylindrical component, said pull toy further including means for flexibly connecting successive components and means to pull said toy, said largest cylindrical component having an open end, the other cylindrical components being fully nested in said largest cylindrical component, said toy including a lid to cover said open end and enclose said other cylindrical components in said largest component, said connecting means containing fastening means, said fastening means capable of being unfastened whereby each cylindrical component can be separated, said flexible connected components capable of moving out of said open end when said lid is removed and said toy is pulled by said pull means.

2. The pull toy of claim 1 wherein said lid includes a mirror on the exterior face thereof.

3. The pull toy of the claim 2 wherein each of said cylindrical components has one open end and one closed end, said means for flexibly connecting successive components comprises a plurality of elastic bands each extending between successive components and containing said fastening means on each end thereof, said fastening means on each band being coupled to fastening means on the elastic band of the succeeding component at about the closed end thereof.

4. The pull toy of claim 3 wherein said fastening means are snap fasteners.

5. The pull toy of claim 4 wherein said largest cylindrical component includes wheels.

6. A pull toy comprising a plurality of hollow, elongated, telescoping components, means for flexibly connecting successive components, one of said successive components containing the remainder of said plurality of components, said one component having an open end to receive said other components and a lid for covering said open end, said connecting means containing fastening means, said fastening means capable of being unfastened whereby each of said components can be separated, said flexibly connected successive components being capable of movement out of said open end of said one component when said lid is removed and said toy is pulled.

7. The pull toy of claim 6 wherein said lid includes a mirror on the exterior surface thereof.

8. The pull toy of claim 6 wherein said components are cylindrical cans with the smaller cans arranged linearly in said largest can, said linear arrangement progressing from largest to smallest, each of said cylindrical cans being slidably nested in the next larger can.

* * * * *